US011284487B2

(12) United States Patent
Wen et al.

(10) Patent No.: US 11,284,487 B2
(45) Date of Patent: Mar. 22, 2022

(54) LED DRIVING CIRCUIT

(71) Applicant: XIAMEN ECO LIGHTING CO. LTD., Xiamen (CN)

(72) Inventors: Shuisheng Wen, Xiamen (CN); Liping Lin, Xiamen (CN); Xiaodeng Chen, Xiamen (CN)

(73) Assignee: XIAMEN ECO LIGHTING CO. LTD., Fujian (CN)

( * ) Notice: Subject to any disclaimer, the term of this patent is extended or adjusted under 35 U.S.C. 154(b) by 10 days.

(21) Appl. No.: 16/852,501

(22) Filed: Apr. 19, 2020

(65) Prior Publication Data

US 2020/0245430 A1 Jul. 30, 2020

Related U.S. Application Data

(63) Continuation-in-part of application No. 16/671,735, filed on Nov. 1, 2019.

(60) Provisional application No. 62/754,054, filed on Nov. 1, 2018.

(51) Int. Cl.

| | |
|---|---|
| ***H05B 45/325*** | (2020.01) |
| ***H05B 45/395*** | (2020.01) |
| ***H05B 33/08*** | (2020.01) |
| ***H05B 45/10*** | (2020.01) |
| ***H05B 45/48*** | (2020.01) |

(52) U.S. Cl.

CPC ..... *H05B 45/325* (2020.01); *H05B 33/08* (2013.01); *H05B 45/10* (2020.01); *H05B 45/395* (2020.01); *H05B 45/48* (2020.01)

(58) Field of Classification Search

CPC .... H05B 45/325; H05B 45/395; H05B 45/10; H05B 45/48; H05B 33/08

See application file for complete search history.

(56) References Cited

U.S. PATENT DOCUMENTS

| | | | | |
|---|---|---|---|---|
| 10,039,171 | B1 * | 7/2018 | Li | H05B 45/14 |
| 2013/0127362 | A1 * | 5/2013 | Trainor | H02J 9/065 315/224 |
| 2013/0141016 | A1 * | 6/2013 | Esaki | H05B 45/10 315/307 |

FOREIGN PATENT DOCUMENTS

CN 201766737 U * 3/2011

* cited by examiner

*Primary Examiner* — Henry Luong

(74) *Attorney, Agent, or Firm* — Chun-Ming Shih; Lanway IPR Services

(57) ABSTRACT

A LED driving circuit includes a DALI module, a linear voltage luminance adjusting module, a DIP luminance adjusting module, a control module, a power source, a constant current driving module and an output module. The DALI module generates a PWM signal. The linear voltage luminance adjusting module generates a second PWM signal. The DIP luminance adjusting module generates a switch signal. The control module generates a drive PWM signal using the first PWM signal, the second PWM signal and the switch signal. The power source provides power. The constant current driving module generates a constant-current drive voltage using the provided power and the drive PWM signal. The output module generates a drive current that responds to the constant-current drive voltage. And the output module drives an external LED device using the drive current.

19 Claims, 3 Drawing Sheets

LED DRIVING CIRCUIT

RELATED APPLICATION

The present application is a continuation-in-part application of U.S. patent application Ser. No. 16/671,735.

FIELD

The present invention relates to a LED driving circuit, and more particularly, to a LED driving circuit capable of accommodating multiple luminance adjusting means for improving luminance adjustment.

BACKGROUND

A conventional LED driving circuit may be adapted to different types of luminance adjustment means. For example, including a digital addressable lighting interface (DALI) means, a 0-10 volt means, or a dual-in-line package (DIP) means. However, such conventional LED driving circuit cannot simultaneously meet any two or more of their requirements because of their unmatching nature and higher hardware cost that is introduced by such unmatching nature.

SUMMARY OF THE INVENTION

The present disclosure aims at disclosing an LED driving circuit. The LED driving circuit includes a digital addressable lighting interface (DALI) module, a linear voltage luminance adjusting module, a dual-in-line package (DIP) luminance adjusting module, a control module, a power source, a constant current driving module and an output module. The DALI module generates a first pulse-width modulation (PWM) signal. The linear voltage luminance adjusting module generates a second PWM signal. The DIP luminance adjusting module generates a switch signal. The control module is electrically coupled to the DALI module, the linear voltage luminance adjusting module and the DIP module. Also, the control module generates a drive PWM signal using the first PWM signal, the second PWM signal and the switch signal. The power source provides power. The constant current driving module is electrically coupled to the power source and the control module. In addition, the constant current driving module generates a constant-current drive voltage using the provided power and the drive PWM signal. The output module is electrically coupled to the constant current driving module. Second, the output module generates a drive current that responds to the constant-current drive voltage. Third, the output module drives an external LED device using the drive current.

In one example, the control module generates the drive PWM signal based on a dynamic combination of PWM ratios for the first PWM signal, the second PWM signal and the switch signal.

In one example, the control module includes a first PWM input terminal, a second PWM input terminal, at least one switch input terminal and a PWM output terminal. The first PWM input terminal is electrically coupled to the linear voltage luminance adjusting module for receiving the second PWM signal. The second PWM input terminal is electrically coupled to the DALI module for receiving the first PWM signal. The at least one switch input terminal is electrically coupled to the DIP luminance adjusting module for receiving the switch signal. The PWM output terminal is electrically coupled to the control module for outputting the drive PWM signal.

In one example, the DALI module includes a DALI luminance self-adjusting chip.

In one example, the linear voltage luminance adjusting module includes a linear luminance adjusting chip and a photo coupler. The linear luminance adjusting chip has an input terminal electrically coupled to the output module for receiving the constant-current drive voltage. Second, the linear luminance adjusting chip has at least one luminance adjusting terminal for receiving a first luminance adjusting signal. Third, the linear luminance adjusting chip has an output terminal for outputting a second luminance adjusting signal. And the linear luminance adjusting chip generates the second luminance adjusting signal based on the first luminance adjusting signal and the constant-current drive voltage. The photo coupler has an input terminal electrically coupled to the output terminal of the linear luminance chip for receiving the second luminance adjusting signal. In addition, the photo coupler has an output terminal for outputting a third luminance adjusting signal. Also, the photo coupler performs photo-electric conversion on the second luminance adjusting signal to generate the third luminance adjusting signal.

In one example, the linear voltage luminance adjusting module further includes a voltage stabilizing diode. The voltage stabilizing diode has a positive terminal electrically coupled to a ground terminal of the photo coupler and ground. Also, the voltage stabilizing diode has a negative terminal electrically coupled to the output terminal of the photo coupler.

In one example, the first luminance adjusting signal is ranged between 0 volts and 10 volts in voltage level.

In one example, the DIP luminance adjusting module includes at least one switch. And each of the at least one switch is electrically coupled to a switch input terminal of the control module for relaying the switch signal.

In one example, the at least one switch is further electrically coupled to a DC voltage source.

In one example, the constant current driving module includes a constant current driving chip, an N-type metal-oxide semiconductor field-effect transistor (MOSFET) and a primary winding of a transformer. The constant current driving chip has a PWM input terminal electrically coupled to the control module for receiving the drive PWM signal. The N-type MOSFET has a gate electrically coupled to a drive terminal of the constant driving current chip. The primary winding of a transformer has a first terminal electrically coupled to a drain of the N-type MOSFET, and has a second terminal electrically coupled to the power source.

In one example, the constant current driving module further includes an npn-type bipolar junction transistor (BJT). And the npn-type BJT has a base electrically coupled to an input power terminal of the constant driving chip and a DC voltage source. Also, the npn-type BJT has an emitter electrically coupled to the power source.

In one example, the constant current driving module further includes a first diode. The first diode has a positive terminal electrically coupled to a power source terminal of the constant current driving chip. In addition, the first diode has a negative terminal electrically coupled to the base of the npn-type BJT.

In one example, the constant current driving module further includes a second diode and a third diode. The second diode has a positive terminal electrically coupled to the emitter of the npn-type BJT. Also, the second diode has a negative terminal electrically coupled to the power source. The third diode has a positive terminal electrically coupled to a first winding. Moreover, the third diode has a negative terminal electrically coupled to a collector of the npn-type BJT.

In one example, the constant current driving module further includes a fourth diode. The fourth diode has a positive terminal electrically coupled to the gate of the N-type MOSFET. Additionally, the fourth diode has a negative terminal electrically coupled to the drive terminal of the N-type MOSFET.

In one example, the constant current driving module further includes a first resistor and a second resistor. The first resistor has a first terminal electrically coupled to the power source. Also, the first resistor has a second terminal electrically coupled to the emitter of the npn-type BJT. The second resistor has a first terminal electrically coupled to a source of the N-type MOSFET. In addition, the second resistor has a second terminal electrically coupled to ground.

In one example, the constant current driving module further includes a capacitor. The capacitor has a first terminal electrically coupled to the drive terminal of the constant current driving chip. Also, the capacitor has a second terminal electrically coupled to the gate of the N-type MOSFET.

In one example, the output module includes a secondary winding of a transformer and a common-mode inductor. The secondary winding of the transformer has a primary winding disposed within the constant current driving module. The common-mode inductor has a first side electrically coupled to the secondary winding. Also, the common-mode inductor has a second side for outputting the drive current.

In one example, the output module further includes a diode. The diode has a first terminal electrically coupled to the secondary winding. Moreover, the diode has a second terminal electrically coupled to the first side of the common-mode inductor.

In one example, the output module further includes a capacitor and a resistor. The capacitor is electrically coupled to the first side of the common-mode inductor in parallel. The resistor is electrically coupled to the capacitor in parallel.

In one example, the LED driving circuit further includes a regulator. The regulator is electrically coupled between the power source and the constant current driving module. And the regulator regulates the provided power and relays the regulated power to the constant current driving module.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present disclosure discloses a LED driving circuit capable of accommodating multiple types of luminance adjustment means. Such that one single LED driving circuit can be used for applying multiple types of luminance adjustment means simultaneously or even synchronously.

Figure 1:
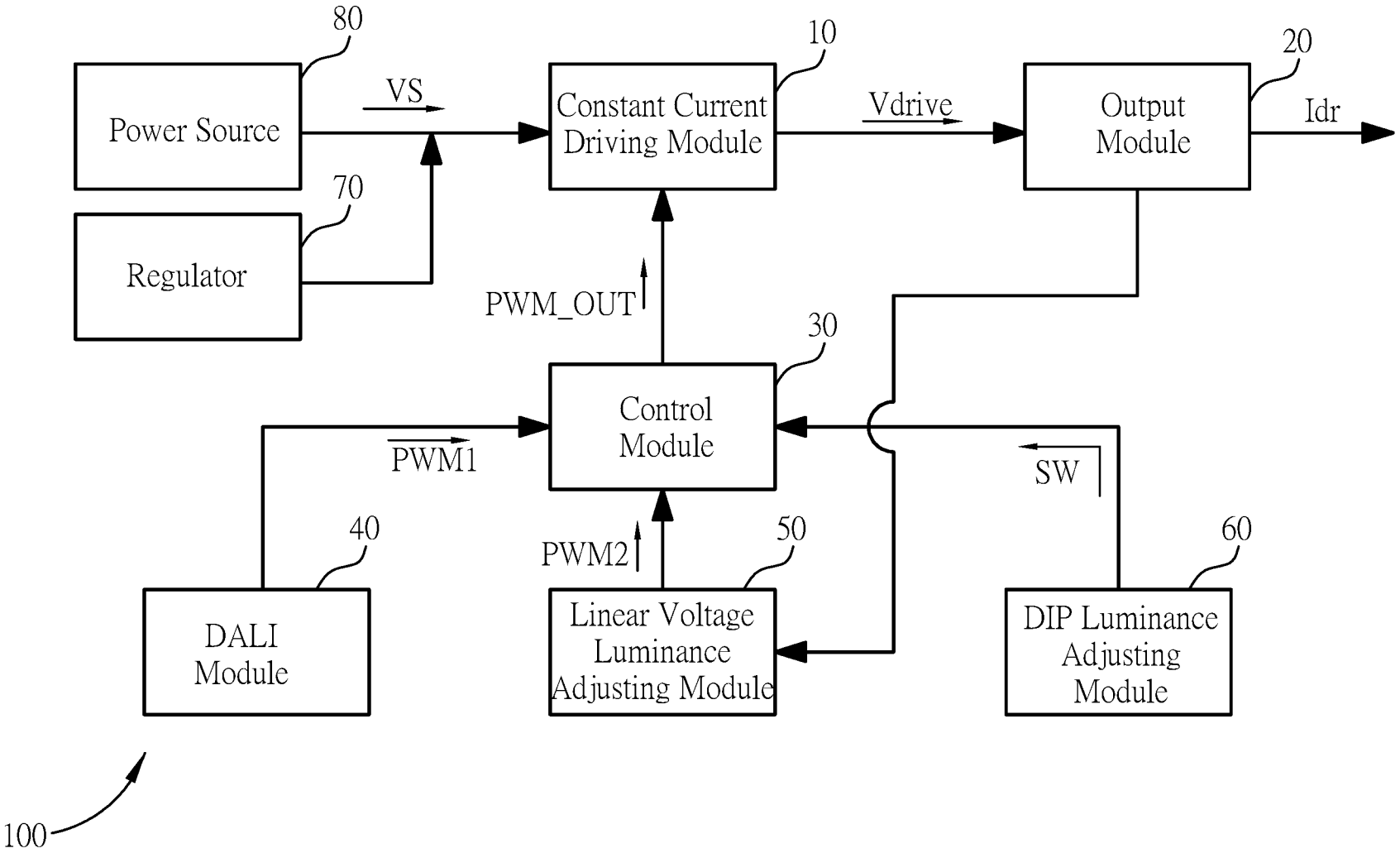
FIG. 1 illustrates a LED driving circuit according to one embodiment.

FIG. 1 illustrates a LED driving circuit 100 according to one embodiment. The LED driving circuit 100 includes a digital addressable lighting interface (DALI) module 40, a linear voltage luminance adjusting module 50, a dual-in-line package (DIP) luminance adjusting module 60, a control module 30, a power source 80, a constant current driving module 10 and an output module 20.

The DALI module 40 generates a first pulse-width modulation (PWM) signal PWM1. DALI is specifically designed for communication-based luminance control. Therefore, in some examples, the DALI module 40 may also be wirelessly connected to an external remote control. Such that a user can control the DALI module 40's detailed setting via the remote control, e.g., the first PWM signal PWM1.

The linear voltage luminance adjusting module 50 generates a second PWM signal PWM2. The DIP luminance adjusting module 60 generates a switch signal SW.

The control module 30 is electrically coupled to the DALI module 40, the linear voltage luminance adjusting module 50 and the DIP luminance adjusting module 60. Also, the control module 30 generates a drive PWM signal PWM_OUT using the first PWM signal PWM1, the second PWM signal PWM2 and the switch signal SW.

The power source 80 provides power VS.

The constant current driving module 10 is electrically coupled to the power source 80 and the control module 30. In addition, the constant current driving module 10 generates a constant-current drive voltage Vdrive using the provided power VS and the drive PWM signal PWM_OUT.

The output module 20 is electrically coupled to the constant current driving module 10. Second, the output module 20 generates a drive current Idr that responds to the constant-current drive voltage Vdrive. Third, the output module 20 drives an external LED device using the drive current Idr.

In this fashion, the control module 30 is capable of incorporating luminance adjusting means respectively directed by the DALI module 40, the linear voltage luminance adjusting module 50, and DIP luminance adjusting module 60 with the aid by appropriately setting respective duty cycles. Such that the conventional LED driving circuit's defects caused by the luminance adjusting means' unmatching nature can be substantially neutralized.

In one example, the control module 30 generates the drive PWM signal PWM_OUT based on a dynamic combination of PWM ratios (i.e., duty cycles) for the first PWM signal PWM1, the second PWM signal PWM2 and the switch signal SW.

Figure 2:
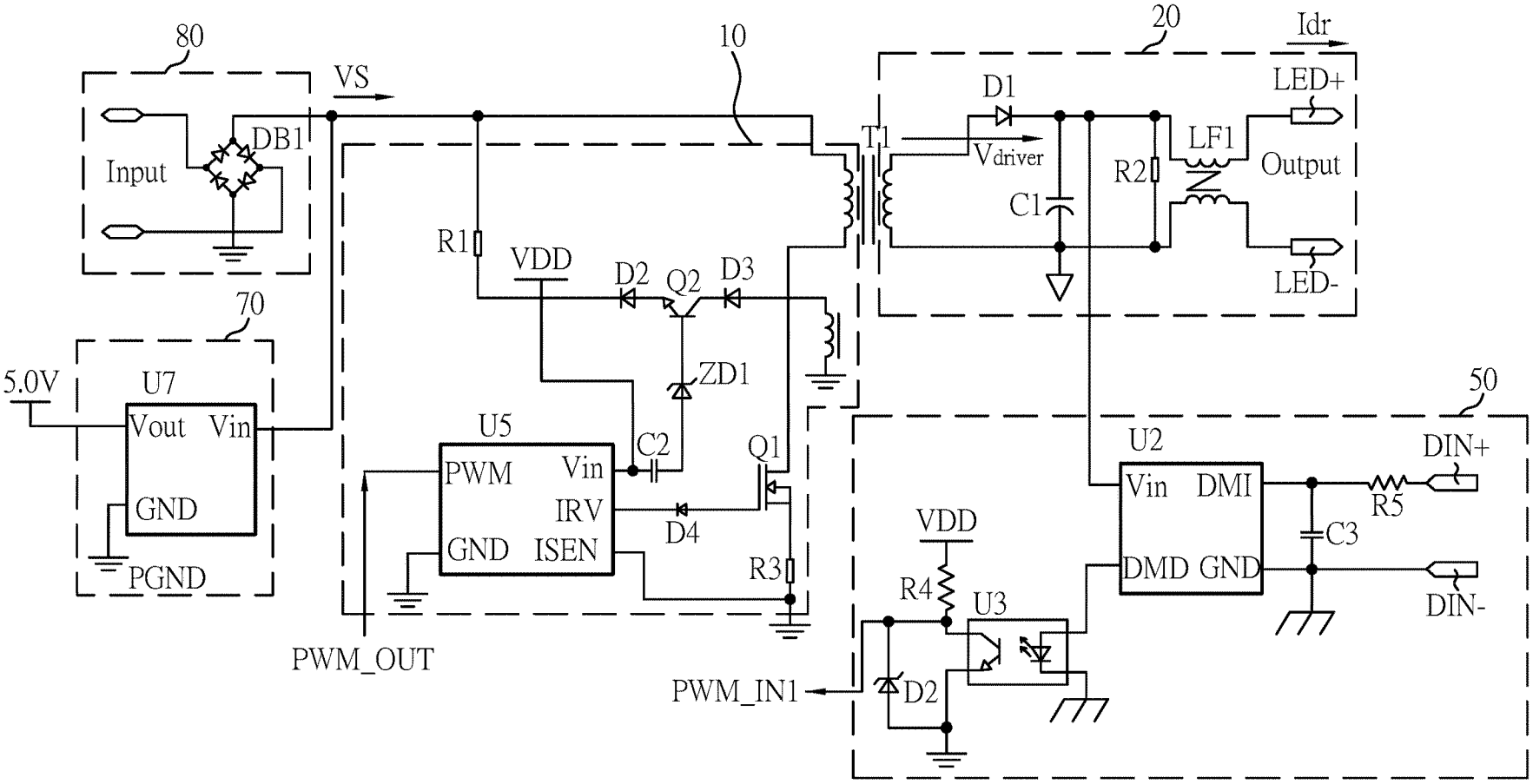
FIG. 2 illustrates an exemplary detailed diagram of part of the LED driving circuit shown in FIG. 1 according to one example.
Figure 3:
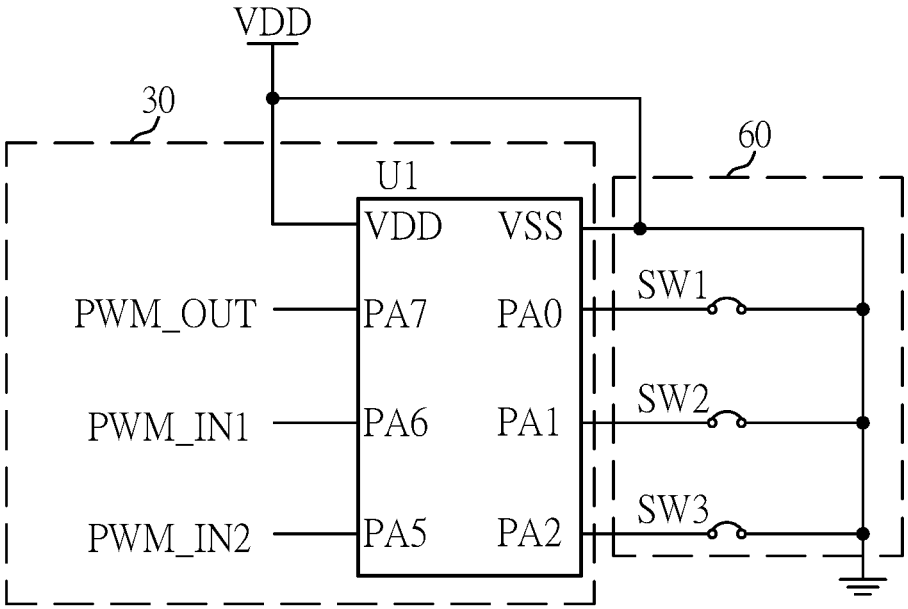
FIG. 3 illustrates an exemplary diagram of the control module shown in FIG. 1.
Figure 4:
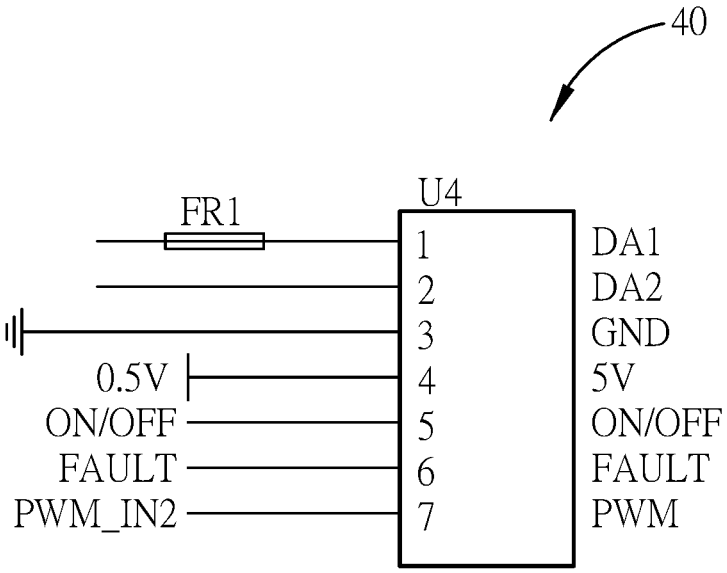
FIG. 4 illustrates an exemplary diagram of the DALI module shown in FIG. 1.

FIG. 2 illustrates an exemplary detailed diagram of part of the LED driving circuit 100 according to one example. FIG. 3 illustrates an exemplary diagram of the control module 30 shown in FIG. 1. And FIG. 4 illustrates an exemplary diagram of the DALI module 40 shown in FIG. 1.

In one example, the control module 30 includes a chip U1, which in turn includes a first PWM input terminal PA6, a second PWM input terminal PA5, at least one switch input terminal (e.g. PA0, PA1 and PA2) and a PWM output terminal PA7. The first PWM input terminal PA6 is electrically coupled to the linear voltage luminance adjusting module 50 for receiving the second PWM signal PWM2. The second PWM input terminal PA5 is electrically coupled to the DALI module 40 for receiving the first PWM signal PWM1. The at least one switch input terminal PA0, PA1 and PA2 is electrically coupled to the DIP luminance adjusting module 60 for receiving the switch signal SW. The PWM output terminal PA7 is electrically coupled to the control module 30 for outputting the drive PWM signal PWM_OUT.

In one example, the DALI module 40 includes a DALI luminance self-adjusting chip U4. Specifically, the self-adjusting chip U4 includes a PWM output terminal PWM_IN2 for electrically coupled to the chip U1's second PWM input terminal. Such that the self-adjusting chip U4 forwards the second PWM signal PWM_IN2 to the chip U1.

In one example, the linear voltage luminance adjusting module 50 includes a linear luminance adjusting chip U2 and a photo coupler U3.

The linear luminance adjusting chip U2 has an input terminal Vin electrically coupled to the output module 20 for receiving the constant-current drive voltage Vdrive. Second, the linear luminance adjusting chip U2 has multiple luminance adjusting terminals DIN+ and DIN− for receiving a first luminance adjusting signal. Third, the linear luminance adjusting chip U2 has an output terminal DMD for outputting a second luminance adjusting signal. And the linear luminance adjusting chip U2 generates the second luminance adjusting signal based on the first luminance adjusting signal and the constant-current drive voltage Vdrive.

The photo coupler U3 has an input terminal electrically coupled to the output terminal DMD of the linear luminance chip U2 for receiving the second luminance adjusting signal. In addition, the photo coupler U3 has an output terminal for outputting a third luminance adjusting signal. Also, the photo coupler U3 performs photo-electric conversion on the second luminance adjusting signal to generate the third luminance adjusting signal. Last, the linear voltage luminance adjusting module 50 outputs the third luminance adjusting signal to the control module 30 in the form of the second PWM signal PWM2, specifically, via the chip U1's first PWM input terminal PA6 (or PWM_IN1).

In one example, the linear voltage luminance adjusting module 50 includes a resistor R4 that is electrically coupled between the photo coupler U3's output terminal and a DC voltage source VDD.

In one example, the linear voltage luminance adjusting module U3 further includes a voltage stabilizing diode D2. The voltage stabilizing diode D2 has a positive terminal electrically coupled to a ground terminal of the photo coupler U3 and ground. Also, the voltage stabilizing diode D2 has a negative terminal electrically coupled to the output terminal of the photo coupler U3. In one example, the first luminance adjusting signal is ranged between 0 volts and 10 volts in voltage level.

As shown in FIG. 3, the DIP luminance adjusting module 60 includes at least one switch that respectively corresponds to the chip U1's at least one switch input terminal via electrical coupling. For example, the DIP luminance adjusting module 60 may include three switches SW1, SW2 and SW3 that respectively corresponds to and be electrically coupled to the chip U1's three switch input terminals PA0, PA1 and PA2. In this way, the switch signal can be relayed to the chip U1 via the switches SW1, SW2 and SW3's respective enabling state. The at least one switch SW1, SW2 and SW3 may also be electrically coupled to a DC voltage source VDD.

As shown in FIG. 2, the constant current driving module 10 includes a constant current driving chip U5, an N-type metal-oxide semiconductor field-effect transistor (MOSFET) Q1 and a primary winding of a transformer T1.

The constant current driving chip U5 has a PWM input terminal Vin electrically coupled to the control module 30 for receiving the drive PWM signal PWM_OUT. The N-type MOSFET Q1 has a gate electrically coupled to a drive terminal IRV of the constant driving current chip U5. The primary winding of the transformer T1 has a first terminal electrically coupled to a drain of the N-type MOSFET Q1. Also, the primary winding of the transformer T1 has a second terminal electrically coupled to the power source 80.

In one example, the constant current driving module 10 also includes an npn-type bipolar junction transistor (BJT) Q2. And the npn-type BJT Q2 has a base electrically coupled to an input power terminal Vin of the constant driving chip U5 and the DC voltage source VDD. Also, the npn-type BJT Q2 has an emitter electrically coupled to the power source 80.

Exemplarily, the constant current driving module 10 further includes a first diode ZD1. The first diode ZD1 has a positive terminal electrically coupled to the input power terminal Vin of the constant current driving chip U5. In addition, the first diode ZD1 has a negative terminal electrically coupled to the base of the npn-type BJT Q2.

The constant current driving module may also include a second diode D2 and a third diode D3. The second diode D2 has a positive terminal electrically coupled to the emitter of the npn-type BJT Q2. Also, the second diode D2 has a negative terminal electrically coupled to the power source 80. The third diode D3 has a positive terminal electrically coupled to the first winding of the transformer T1. Moreover, the third diode D3 has a negative terminal electrically coupled to a collector of the npn-type BJT Q2.

In one example, the constant current driving module 10 may additionally include a fourth diode4. The fourth diode D4 has a positive terminal electrically coupled to the gate of the N-type MOSFET Q1. Also, the fourth diode D4 has a negative terminal electrically coupled to the drive terminal IRV of the N-type MOSFET Q1.

In one example, the constant current driving module 10 further includes a first resistor R1 and a second resistor R3. The first resistor R1 has a first terminal electrically coupled to the power source 80. Also, the first resistor R1 has a second terminal electrically coupled to the emitter of the npn-type BJT Q2. The second resistor R3 has a first terminal electrically coupled to a source of the N-type MOSFET Q1. In addition, the second resistor R3 has a second terminal electrically coupled to ground.

In one example, the constant current driving module 10 further includes a capacitor C2. The capacitor C2 has a first terminal electrically coupled to the input power terminal Vin of the constant current driving chip 10. Also, the capacitor C2 has a second terminal electrically coupled to the gate of the N-type MOSFET Q2.

As shown in FIG. 2, exemplarily, the output module 20 includes a secondary winding of the transformer T1 and a common-mode inductor LF1. The common-mode inductor LF1 has a first side electrically coupled to the secondary winding of the transformer T1. Also, the common-mode inductor LF1 has a second side for outputting the drive current Idr, specifically, to a positive terminal LED+ and a negative terminal LED− of at least one LED unit.

In one example, the output module 20 further includes a diode D1. The diode D1 has a first terminal electrically coupled to the secondary winding of the transformer T1. Moreover, the diode D1 has a second terminal electrically coupled to the first side of the common-mode inductor LF1.

In one example, the output module 20 further includes a capacitor C1 and a resistor R2. The capacitor C1 is electrically coupled to the first side of the common-mode inductor LF1 in parallel. The resistor R2 is electrically coupled to the capacitor C1 in parallel.

As shown in FIG. 2, the LED driving circuit 100 may further include a regulator 70. The regulator 70 is electrically coupled between the power source 80 and the constant current driving module 10. And the regulator 70 regulates the provided power VS and relays the regulated power VS to the constant current driving module 10.

In some examples, the power source 80 may have a half-bridge regulator DB1 for voltage regulation, which may also be replaced by a full-bridge regulator in some other examples.

In summary, the disclosed LED driving circuit 100 incorporates multiple luminance adjustment means, such as DALI, linear adjustment (e.g. of 0-10 volts), and DIP. Since the control module 30 is capable of adjusting duty cycles for these luminance adjusting means, the LED driving circuit 100 can dynamically control its output circuit Idr for meeting various requirements and/or types of LED units. In addition, the LED driving circuit 100's accommodation with multiple luminance adjusting means prevents additional hardware cost introduced by a conventional LED driving circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An LED driving circuit, comprising:

a digital addressable lighting interface (DALI) module, configured to generate a first pulse-width modulation (PWM) signal;

a linear voltage luminance adjusting module, configured to generate a second pulse-width modulation signal;

a dual-in-line package (DIP) luminance adjusting module, configured to generate a switch signal;

a control module, electrically coupled to the DALI module, the linear voltage luminance adjusting module and the DIP module, and configured to generate a drive PWM signal using the first PWM signal, the second PWM signal and the switch signal;

a power source, configured to provide power;

a constant current driving module, electrically coupled to the power source and the control module, and configured to generate a constant-current drive voltage using the provided power and the drive PWM signal; and an output module, electrically coupled to the constant current driving module, configured to generate a drive current that responds to the constant-current drive voltage, and configured to drive an external LED device using the drive current, wherein the output module comprises:

a secondary winding of a transformer, whose primary winding is disposed within the constant current driving module; and a common-mode inductor, having a first side electrically coupled to the secondary winding, and having a second side for outputting the drive current.

2. The LED driving circuit of claim 1, wherein the control module is further configured to generate the drive PWM signal based on a dynamic combination of PWM ratios for the first PWM signal, the second PWM signal and the switch signal.

3. The LED driving circuit of claim 1, wherein the control module comprises:

a first PWM input terminal, electrically coupled to the linear voltage luminance adjusting module for receiving the second PWM signal;

a second PWM input terminal, electrically coupled to the DALI module for receiving the first PWM signal;

at least one switch input terminal, electrically coupled to the DIP luminance adjusting module for receiving the switch signal; and a PWM output terminal, electrically coupled to the control module for outputting the drive PWM signal.

4. The LED driving circuit of claim 1, wherein the DALI module comprises a DALI luminance self-adjusting chip.

5. The LED driving circuit of claim 1, wherein the linear voltage luminance adjusting module comprises:

a linear luminance adjusting chip, having an input terminal electrically coupled to the output module for receiving the constant-current drive voltage, having at least one luminance adjusting terminal for receiving a first luminance adjusting signal, and having an output terminal for outputting a second luminance adjusting signal, wherein the linear luminance adjusting chip is configured to generate the second luminance adjusting signal based on the first luminance adjusting signal and the constant-current drive voltage; and a photo coupler, having an input terminal electrically coupled to the output terminal of the linear luminance chip for receiving the second luminance adjusting signal, and having an output terminal for outputting a third luminance adjusting signal, wherein the photo coupler is configured to perform photo-electric conversion on the second luminance adjusting signal to generate the third luminance adjusting signal.

6. The LED driving circuit of claim 5, wherein the linear voltage luminance adjusting module further comprises a voltage stabilizing diode, having a positive terminal electrically coupled to a ground terminal of the photo coupler and ground, and having a negative terminal electrically coupled to the output terminal of the photo coupler.

7. The LED driving circuit of claim 5, wherein the first luminance adjusting signal is ranged between 0 volts and 10 volts in voltage level.

8. The LED driving circuit of claim 1, wherein the DIP luminance adjusting module comprises at least one switch, each of which is electrically coupled to a switch input terminal of the control module for relaying the switch signal.

9. The LED driving circuit of claim 8, wherein the at least one switch is further electrically coupled to a DC voltage source.

10. The LED driving circuit of claim 1, wherein the constant current driving module comprises:

a constant current driving chip, having a PWM input terminal electrically coupled to the control module for receiving the drive PWM signal;

an N-type metal-oxide semiconductor field-effect transistor (MOSFET), having a gate electrically coupled to a drive terminal of the constant driving current chip; and a primary winding of a transformer, having a first terminal electrically coupled to a drain of the N-type MOSFET, and having a second terminal electrically coupled to the power source.

11. The LED driving circuit of claim 10, wherein the constant current driving module further comprises:

an npn-type bipolar junction transistor (BJT), having a base electrically coupled to an input power terminal of the constant driving chip and a DC voltage source, and having an emitter electrically coupled to the power source.

12. The LED driving circuit of claim 11, wherein the constant current driving module further comprises:

a first diode, having a positive terminal electrically coupled to the input power terminal of the constant current driving chip, and having a negative terminal electrically coupled to the base of the npn-type BJT.

13. The LED driving circuit of claim 11, wherein the constant current driving module further comprises:

a second diode, having a positive terminal electrically coupled to the emitter of the npn-type BJT, and having a negative terminal electrically coupled to the power source; and a third diode, having a positive terminal electrically coupled to a first winding, and having a negative terminal electrically coupled to a collector of the npn-type BJT.

14. The LED driving circuit of claim 11, wherein the constant current driving module further comprises:

a fourth diode, having a positive terminal electrically coupled to the gate of the N-type MOSFET, and having a negative terminal electrically coupled to the drive terminal of the N-type MOSFET.

15. The LED driving circuit of claim 11, wherein the constant current driving module further comprises:

a first resistor, having a first terminal electrically coupled to the power source, and having a second terminal electrically coupled to the emitter of the npn-type BJT; and a second resistor, having a first terminal electrically coupled to a source of the N-type MOSFET, and having a second terminal electrically coupled to ground.

16. The LED driving circuit of claim 11, wherein the constant current driving module further comprises:

a capacitor, having a first terminal electrically coupled to the input power terminal of the constant current driving chip, and having a second terminal electrically coupled to the gate of the N-type MOSFET.

17. The LED driving circuit of claim 1, wherein the output module further comprises:

a diode, having a first terminal electrically coupled to the secondary winding, and having a second terminal electrically coupled to the first side of the common-mode inductor.

18. The LED driving circuit of claim 1, wherein the output module further comprises:

a capacitor, electrically coupled to the first side of the common-mode inductor in parallel; and a resistor, electrically coupled to the capacitor in parallel.

19. The LED driving circuit of claim 1, further comprising:

a regulator, electrically coupled between the power source and the constant current driving module, and configured to regulate the provided power and relay the regulated power to the constant current driving module.

* * * * *